US011001355B2

(12) United States Patent
Lemer et al.

(10) Patent No.: US 11,001,355 B2
(45) Date of Patent: May 11, 2021

(54) BALLAST FOR DEEP-SEA DIVING BELT

(71) Applicant: OPALIS, La Chapelle sur Erdre (FR)

(72) Inventors: Pierre-Marie Lemer, Nantes (FR); Michel Le Vigouroux, Les Sorinieres (FR)

(73) Assignee: OPALIS, La Chapelle sur Erdre (FR)

( * ) Notice: Subject to any disclaimer, the term of this patent is extended or adjusted under 35 U.S.C. 154(b) by 45 days.

(21) Appl. No.: 16/475,302

(22) PCT Filed: Dec. 28, 2017

(86) PCT No.: PCT/EP2017/084719
§ 371 (c)(1),
(2) Date: Jul. 1, 2019

(87) PCT Pub. No.: WO2018/122313
PCT Pub. Date: Jul. 5, 2018

(65) Prior Publication Data

US 2019/0329854 A1 Oct. 31, 2019

(30) Foreign Application Priority Data

Dec. 30, 2016 (FR) ..... 1663563

(51) Int. Cl.
*B63C 11/30* (2006.01)

(52) U.S. Cl.
CPC ..... *B63C 11/30* (2013.01)

(58) Field of Classification Search
CPC ..... B63B 11/30; B63C 11/30
See application file for complete search history.

(56) References Cited

U.S. PATENT DOCUMENTS 3,851,488 A 12/1974 Schuler
4,239,211 A * 12/1980 Wilkerson ..... A63B 21/065 156/301

FOREIGN PATENT DOCUMENTS

| | | |
|---|---|---|
| FR | 2 142 551 | 2/1973 |
| GB | 2 346 539 | 8/2000 |
| GR | 1 007 644 | 7/2012 |
| JP | 56-161888 | 12/1981 |

OTHER PUBLICATIONS

International Search Report, PCT/EP2017/084719, dated Mar. 21, 2018.

* cited by examiner

*Primary Examiner* — Stephen P Avila
(74) *Attorney, Agent, or Firm* — Nixon & Vanderhye

(57) ABSTRACT

Disclosed is a ballast for a underwater diving belt, the ballast including a metal core covered with a coating, and a unit for the assembly thereof to a belt strip. The coating is in the form of an add-on shell consisting of at least one shell part made of a plastic material and held around the metal core by a fastener.

11 Claims, 2 Drawing Sheets

BALLAST FOR DEEP-SEA DIVING BELT

TECHNICAL FIELD TO WHICH THE INVENTION RELATES

The present invention relates, generally, to equipment for practising underwater diving.

It relates, in particular, to a ballast for underwater diving belts.

TECHNOLOGICAL BACKGROUND

A ballast is a heavy body which is used to ballast/load an element, this with the aim, in particular, of increasing the mass thereof.

In underwater diving, ballasts are used by divers to immerse themselves correctly.

This ballast is, for example, produced by means of a underwater diving belt, also commonly designated "lead belt" or "ballast belt".

Such a belt conventionally comprises a belt strip which is held around the waist of the diver by a quick fixing system. To ensure the ballast, ballasts are distributed over the length of this belt strip.

The ballasts in question can consist of a part made of raw lead. But, these ballasts, which are standard, are not very successful and fragile.

The ballasts can also consist of a part comprising a metal core (made of lead, for example) which is covered by a coating, generally a plastic coating.

The coating is generally deposited by immersing the metal core in the coating material which is in liquid form; this material is then frozen around the metal core to form the coating.

These "coated" ballasts are more respectful of the environment and more resistant.

But, such a coating technique requires a lot of handlings of heavy products; the method implemented takes time and it is relatively expensive.

In addition, the coating obtained generally comprises a solid colour, with reduced possibilities of aesthetic choice and personalisation; it gives no choice either to the surface condition.

Furthermore, the close assembly between the metal core and the coating complicates and limits the recycling possibilities of such "coated" ballasts.

Consequently, it would be useful to be able to have ballasts which have a greater aesthetic variety, but also to facilitate the placement of the coating on the metal core.

AIM OF THE INVENTION

In order to overcome the abovementioned disadvantage of the state of the art, the present invention proposes a new ballast structure for a underwater diving belt.

This ballast comprises—a metal core covered with a coating, and—means for the assembly thereof with a belt strip;

and it is characterised by the fact that said coating is in the form of an add-on shell consisting of at least one shell part made of a plastic material and which is held around said metal core by fastening means.

According to a useful embodiment, the metal core has an outer surface which comprises:

two front faces, a peripheral face connecting said front faces, and two through slots, opening at the level of said front faces, each adapted to be used as a passage for a belt strip, said coating being in the form of an add-on shell consisting of the assembly of at least two shell parts which are made of a plastic material and which are held around said metal core by fastening means.

Other non-limiting and advantageous characteristics of the ballast according to the invention, taken individually or according to any technically possible combinations, are as follows:

- the shell part(s) comprise(s) an inner surface which moulds a portion of the outer surface of the metal core;
- the coating comprises two complementary shell parts, which shell parts each comprise: (i) a main wall covering a front face of the metal core, said main wall comprising two openings each facing one of the through slots of the metal core, (ii) a peripheral sleeve, connected to a peripheral edge of said main wall, covering a portion of the height of the peripheral face of the metal core, and (iii) two central sleeves, each connected to one of said openings, covering a portion of the height of one of the through slots of the metal core; in this scope, the metal core advantageously comprises a median plane, parallel to and at equal distance from the front faces thereof and the peripheral sleeve and the central sleeves each comprise a free edge extending to the level of said median plane;
- the fastening means are selected from among at least one of the following fastening means: means for gluing shell part(s) with the metal core and/or one with the other, means for interlocking the shell part(s) with the metal core and/or one with the other, means for thermowelding shell parts together; preferably, the peripheral sleeve and the central sleeves comprise a free edge, and the free edges of one of the shell parts engage by interlocking with the free edges of the other of the shell parts; preferably also, the free edges of one of the shell parts comprise an outer cavity and the free edges of the other of the shell parts comprise a complementary inner cavity;
- the coating comprises, facing each front face of the central core, a main wall comprising a central portion arranged between two side portions, separated by two openings; and at the level of one of the main walls, the central portion is removed with respect to the side portions; while at the level of the other of the main walls, the side portions are removed with respect to the central portion.

The present invention also relates to a underwater diving belt, comprising a belt strip on which ballasts are added, such as defined above.

The present invention also relates to a method for producing such a ballast.

This method comprises:—a step of providing the metal core and the shell part(s), and—a step of fastening the shell part(s) with the metal core and/or one with the other for the holding thereof around said metal core.

Preferably, the step of providing the shell part(s) comprises an operation for producing said shell part(s) by injection moulding.

DETAILED DESCRIPTION OF AN EMBODIMENT EXAMPLE

The following description regarding the appended drawings given as non-limiting examples, will make it best understood, what the invention consists of, and how it can be achieved.

Figure 1:
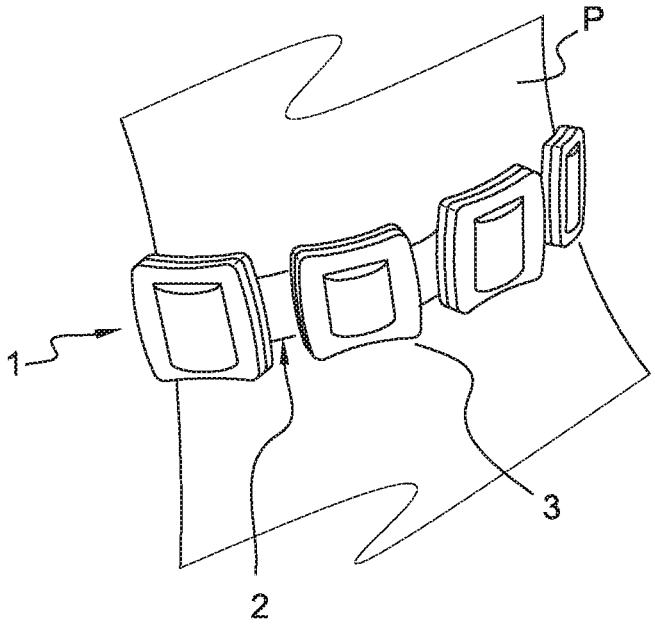
FIG. 1 is a general, schematic and perspective view of a underwater diving belt which is equipped with ballasts according to the invention, and which is wound around the waist of a diver (only the waist of this diver is represented)

The underwater diving belt 1, represented in FIG. 1, is intended to equip the waist of a diver P (only the waist of this diver is represented highly schematically in FIG. 1).

This diving belt 1, also commonly designated "lead belt", consists of a ballast which will make it possible for the diver to be immersed correctly and without difficult in the water environment.

For this, the diving belt 1 comprises:—a belt strip 2, and—several ballasts 3, also commonly designated "lead".

The diving belt 2 can be made of different materials, for example, polypropylene (nylon type), rubber, etc.

This diving belt 2 is equipped with closing means (not represented), conventional in itself, for example a plastic loop or a metal loop.

The ballasts 3 are added-on and distributed over the length of the belt strip 2.

Figure 2:
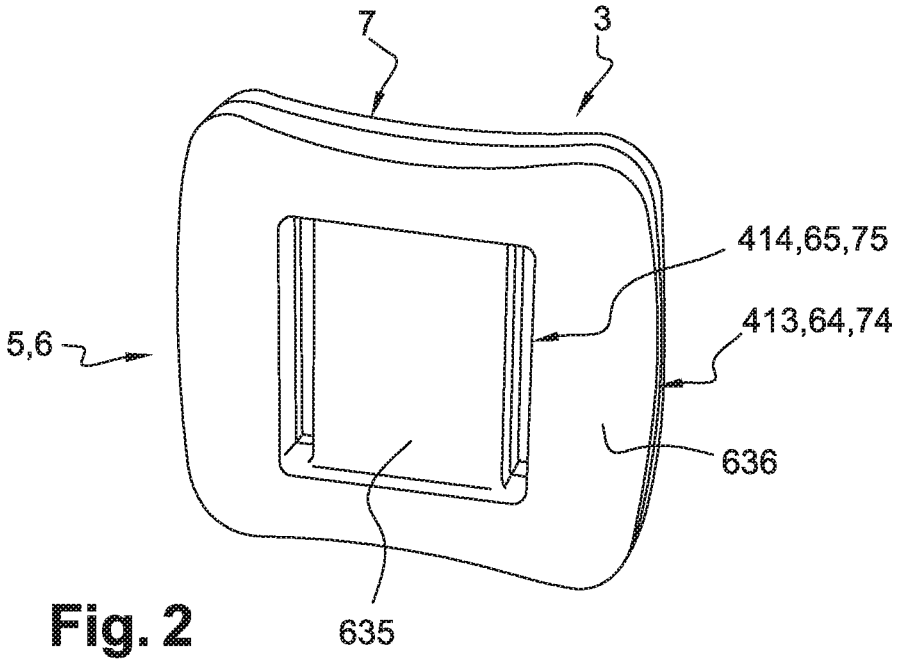
FIG. 2 represents, in an isolated and perspective manner, one of the ballasts equipping the underwater diving belt according to FIG. 1.
Figure 3:
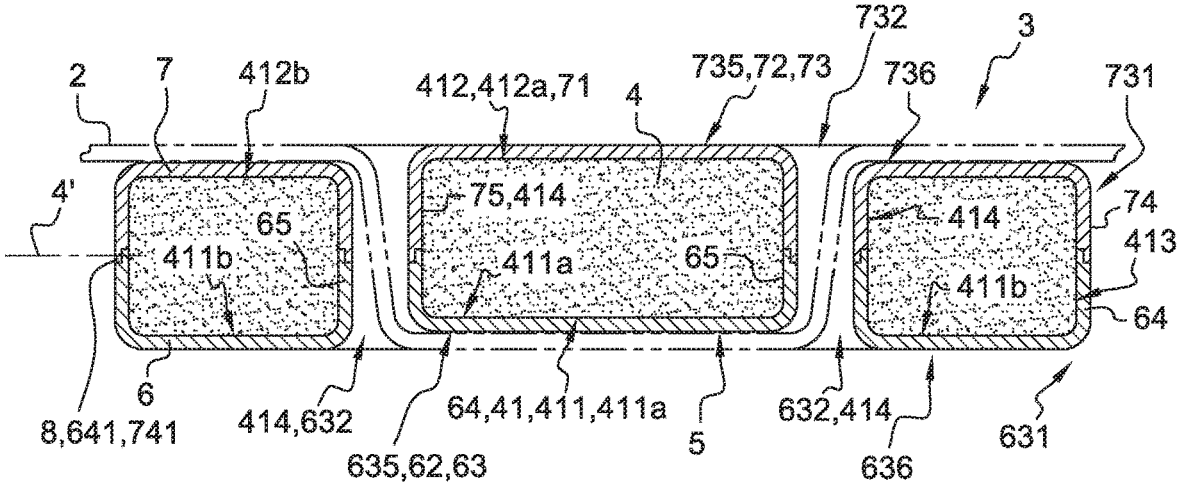
FIG. 3 is a cross-sectional view of the ballast according to FIG. 2, of which the cross-sectional plane extending perpendicularly to the through slots.

One of these ballasts 3 is illustrated generally, and schematically, in FIGS. 2 and 3. The other ballasts 3 equipping the belt strip 2 have advantageously an identical or similar structure.

Such as illustrated in FIG. 3, the ballast 3 is formed by the assembly of two elements:

- a metal core 4, ensuring the ballast function, and
- a coating 5, intended in particular to protect the metal core 4 and to improve the visual appearance of the ballast 3.

Metal Core

The metal core 4 is advantageously made of one single piece, typically made of lead.

This metal core has, for example, a weight of between 500 g and 2 kg.

This metal core 4 has an outer surface 41, of general parallelepiped shape, which comprises:

- two front faces 411, 412, of general square or rectangular shape,
- a peripheral face 413, connecting the two abovementioned front faces 411, 412, and
- two through slots 414 which open at the level of the two front faces 411, 412 and which are each adapted to be used as a passage for the belt strip 2 (and therefore being used as an assembly means with the belt strip 2).

The metal core 4 comprises a general median plane 4', extending parallel to and at equal distance from the two front faces 411, 412.

Each front face 411, 412 comprises juxtaposed portions:

- a central portion 411*a*, 412*a*, respectively, which is arranged between the two through slots 414, and
- two side portions 411*b*, 412*b*, respectively, each located between one of the through slots 414 and the peripheral face 413.

Each through slot 414 has an extended shape, with a horizontal section (parallel to the general median plane 4') which is of general rectangular shape.

Coating

The coating 5 is in the form of a shell constituted by the assembly of shell parts 6, 7 which are held around the metal core 4 by fastening means 8.

Figure 4:
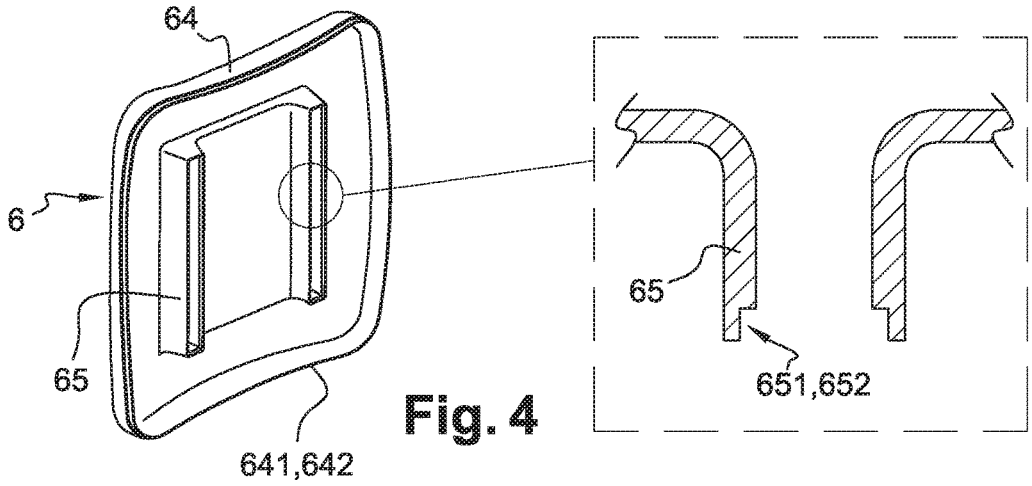
FIGS. 4 and 5 represent, in an isolated and perspective manner, the two complementary shell parts, disconnected from the metal core; these FIGS. 4 and 5 also each comprise a section intended to show the shape of the free edge of these shell parts.
Figure 5:
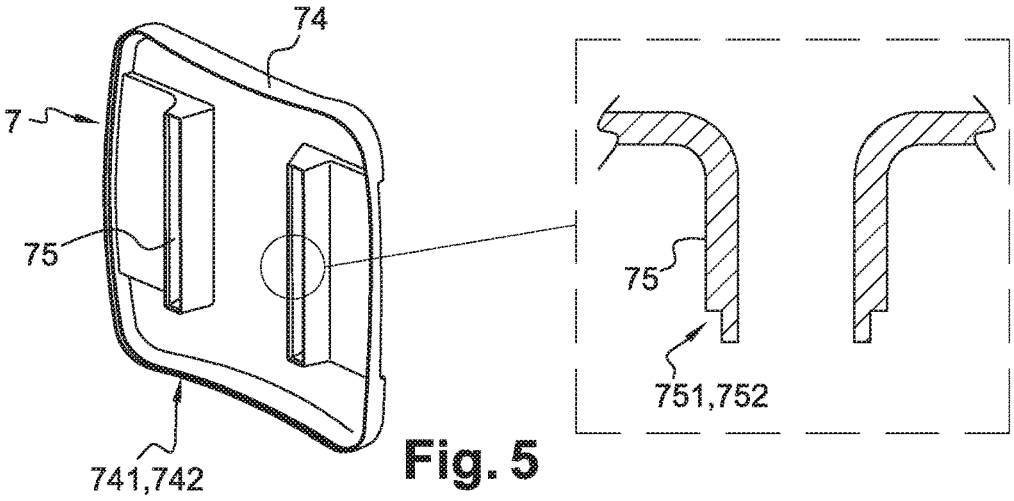

The shell parts 6, 7, represented individually in FIGS. 4 and 5, are made of plastic material, advantageously rigid or semi-rigid, namely for example, vinyl polychloride (PVC), polyethylene, ABS, polyamide, etc.

Such as illustrated by FIGS. 3 to 5, the coating 5 here comprises two shell parts 6, 7, complementary with respect to one another. These shell parts 6, 7 and shaped so as to cover all of the outer surface 41 of the metal core 4.

In this case, each shell part 6, 7 comprises two opposite surfaces:

- an inner surface 61, 71, respectively, which moulds a portion of the outer surface 41 of the metal core 4, and
- an outer surface 62, 72, respectively, which forms the outer surface of the ballast 3.

The outer surface 62, 72 of the shell parts 6, 7 advantageously comprises an aesthetic aspect or a decoration, for example a camouflage pattern, which makes it possible to adjust, as desired, the appearance of the ballast 3.

The two surfaces 61, 62 and 71, 72 of a shell part 6, 7 here extend parallel, or at least approximately parallel, with respect to one another.

These two surfaces 61, 62 and 71, 72 define the thickness of the shell part 6, 7. This thickness is, for example, of between 0.1 and 3 mm.

Each shell part 6, 7 comprises several portions:

- a main wall 63, 73, respectively, covering a front face 411, 412 of the metal core 4,
- a peripheral sleeve 64, 74, respectively, covering and moulding a portion of the height of the peripheral face 413 of the metal core 4 (for example, half of the height), and
- two central sleeves 65, 75, respectively, covering and moulding a portion of the height of one of the through slots 414 of the metal core 4 (for example, half of the height).

The main wall 63, 73 of each shell part 6, 7 comprises:

- a peripheral edge 631, 731, here of general rectangular shape, to which is connected the peripheral sleeve 64, 74, and
- two openings 632, 732, each of extended rectangular shape, to each of which is connected one of the two central sleeves 65, 75 and intended to each face one of the through slots 414 of the metal core 4.

The peripheral sleeves 64, 74 and the central sleeves 65, 75 each comprise a free edge 641, 741, 651, 751, respectively.

These different free edges 641, 741, 651, 751 are intended here to extend parallel to the general median plane 4' of the metal core 4, even at the level of this general median plane 4'.

The main wall 63, 73 of each shell part 6, 7 also comprises a central portion 635, 735 arranged between the two openings 632, 732, themselves arranged between two side portions 636, 736.

At the level of each main wall 63, 73, the central portion 635, 735 is offset in height with respect to the juxtaposed side portions 636, 736.

By "offset in height", this also means an offsetting between, on the one hand, the plane passing through the central portion 635, 735 and, on the other hand, the plane passing through the side portions 636, 736.

This offset in height corresponds advantageously, approximately, to the thickness of the belt strip 2, intended to be thread through the ballast 3, to optimise the positioning thereof on the diver, and such that the belt strip 2 extends into the thickness of the ballast 3.

In this case, the ballast 3 comprises:

at the level of a first main wall 63, a central portion 635 removed with respect to the juxtaposed side portions 636, and at the level of a second main wall 73, two side positions 736 removed from the central portion 735.

In other words, a "removed" portion is located at a reduced distance from the general median plane 4', with respect to at least one juxtaposed portion.

Fastening Means

The two shell parts 6, 7 are held around the metal core 4 by fastening means 8.

For this, the fastening means 8 are advantageously selected from among at least one of the following fastening means:

means for gluing the shell parts 6, 7, one with the other and/or with the metal core 4, means for interlocking the shell parts 6, 7, one with the other and/or with the metal core 4, and means for thermowelding shell parts 6, 7 together.

In this case, the fastening means 8 comprise interlocking means arranged at the level of the abovementioned free edges 641, 741, 651, 751.

More specifically, the free edges 641, 651 of one of the shell parts 6 engage by interlocking with the free edges 741, 751 of the other of the shell parts 6, 7.

The free edges 641, 651 of a shell part 6 comprise a dihedral inner cavity 642, 652 (illustrated in detail for a central sleeve 65 in FIG. 5).

By "inner cavity", this means a cavity arranged at the level of the inner surface of the sleeve.

The free edges 741, 751 of the other shell part 7 each comprise a dihedral outer cavity 742, 752 (illustrated in detail for a central sleeve 75 in FIG. 4) which is complementary to an abovementioned inner cavity 642, 652.

By "outer cavity", this means a cavity arranged at the level of the outer surface of the sleeve.

Each cavity 642, 652, 742, 752 advantageously extends over half of the thickness of the associated sleeve 64, 65, 74, 75.

Moreover, the gluing means consist, for example, of a glue added-on between the inner surface 61, 71 of the shell parts 6, 7 and the outer surface 41 of the metal core 4; complementarily or alternatively, this glue can be deposited at the level of the associated free edges 641, 741 and 651, 751.

This glue is, for example, selected from among plastic material solvents, cyanoacrylates, epoxides, neoprenes, etc.

The thermowelding means consist, for example, of carrying out a thermal welding at the level of the associated free edges 641, 741 and 651, 751 to form a welding line.

This thermowelding is, for example, carried out by means of a high-frequency welding or heating blades.

It can thus be considered, to combine several fastening means, for example, an interlocking of two shell parts 6, 7, associated with a gluing or a high-frequency welding at the level of the interlocking lines.

Method for Producing a Ballast and the Belt

Producing a ballast 3 according to the invention comprises the following steps:

a step of providing the metal core 4 and shell parts 6, 7, then a step of fastening shell parts 6, 7 around the metal core 4.

The step of providing the shell parts 6, 7 comprises advantageously a step of producing these shell parts 6, 7 by compression, thermoforming or also preferably by injection moulding.

Each shell part 6, 7 produced thus comprises an aesthetic pattern, or décor, sought.

The fastening step consists, as the case may be, of at least one of the following fastening steps: gluing, interlocking, thermowelding.

In particular, each shell part 6, 7 is added-on, such that the inner surface 61, 71 thereof covers a portion of the metal core 4:

a main wall 63, 73, respectively, covering a front face 411, 412 of the metal core 4, a peripheral sleeve 64, 74, respectively, covering and moulding a portion of the height of the peripheral face 413 of the metal core 4 (for example, half of the height), and two central sleeves 65, 75, respectively, covering and moulding a portion of the height of one of the through slots 414 of the metal core 4 (for example, half of the height).

The metal core 4 is thus fully covered by the two shell parts 6, 7, here forming a continuous shell.

Each ballast 3 can then be assembled on the belt strip 2.

For this, a free end of the belt strip 2 is threaded through the through slots 414 covered with the central sleeves 65, 75.

The free end of the belt strip 2 is successively introduced:

through a first through slot 414 (on the left in FIG. 3), from the main wall 73 of a second shell part 7 (at the top in FIG. 3) towards the main wall 63 of a first shell part 6 (at the bottom in FIG. 3), then through a second through slot 414 (on the right in FIG. 3), from the main wall 63 of the first shell part 6 towards the main wall 73 of the second shell part 7.

The belt strip 2 thus rests on the two side portions 736 removed from the second main wall 73, and on the central portion 635 removed from the first main wall 63.

As a variant, one single shell part prepared in advance can be used to cover a portion (preferably, the main portion) of the metal core 4. The assembly of this shell part (shaped as desired) with the associated metal core can thus be carried out by gluing or by deforming said shell part.

Also, as a variant, means other than through slots can be considered to assemble the shell part(s) with the belt strip (for example, receiving pockets arranged in the belt strip, self-adhesive type fastening systems, etc.). The structure of the metal core and of the shell part(s) will consequently be adapted.

Generally, the ballast 3 according to the invention makes it possible to select the shell parts which are added-on on the metal core, for example, according to the appearance sought by divers.

The ballast 3 according to the invention has the following advantages:

easy personalisation of the outer shapes of the shell(s) without change in geometry of the metal core very legible personalisation of the shell(s) by etching in the production mould production speed of the shells and assembly of the shells with the metal core relatively low cost numerous colour, décor, hardness and surface appearance choices (structured or smooth)

easy disassembly between shell(s) and metal core, which facilitate recycling possibility to integrate a repelling agent in the material of the shells (or in an adapted housing, arranged on the shells), or other functionalities such as hooks, etc.

The invention claimed is:

1. A ballast for underwater diving belt, which ballast (3) comprises a metal core (4) covered with a coating (5), and means for the assembly thereof with a belt-strip, wherein said coating (5) is in the form of an add-on shell consisting of at least one shell part (6, 7) which is made of a plastic material and which is held around said metal core (4) by fastening means (8), wherein the metal core (4) has an outer surface (41) which comprises:

two front faces (411, 412), a peripheral face (413) connecting said front faces (411, 412), and two through slots (414), opening at the level of said front faces (411, 412), each adapted to be used as a passage for a belt strip, said coating (5) being in the form of an add-on shell consisting of the assembly of at least two shell parts (6, 7) which are made of a plastic material and which are held around said metal core (4) by fastening means (8), and wherein the coating (5) comprises two complementary shell parts (6, 7), which shell parts (6, 7) each comprise:

a main wall (63, 73) covering a front face (411, 412) of the metal core (4), said main wall (63, 73) comprising two openings (632, 732) each facing one of the through slots (414) of the metal core (4), a peripheral sleeve (64, 74) connected to a peripheral edge (631, 731) of said main wall (63, 73), covering a portion of the height of the peripheral face (413) of the metal core (4), and two central sleeve (65, 75), each connected to one of said openings (632, 732), covering a portion of the height of one of the through slots (414) of the metal core (4).

2. The ballast for underwater diving belt, according to claim 1, wherein the shell part(s) (6, 7) comprise an inner surface (61, 71) which moulds a portion of the outer surface (41) of the metal core (4).

3. The ballast for underwater diving belt, according to claim 1, wherein the metal core (4) comprises a median plane (4'), parallel to and at distance equal from the front faces (411, 412) thereof, and wherein the peripheral sleeve (64, 74) and the central sleeves (65, 75) each comprise a free edge (641, 741, 651, 751) parallel to said median plane (4').

4. The ballast for underwater diving belt, according to claim 3, wherein the fastening means (8) are selected from among at least one of the following fastening means:

means for gluing the shell part(s) (6, 7) with the metal core (4) and/or one with the other, means for interlocking the shell part(s) (6, 7) with the metal core (4) and/or one with the other, means for thermowelding shell parts (6, 7) together.

5. The ballast for underwater diving belt, according to claim 4, wherein the peripheral sleeve (64, 74) and the central sleeves (65, 75) comprise a free edge (641, 741, 651, 751), and wherein the free edges (641, 651) of one of the shell parts (6) engage by interlocking with the free edges (741, 751) of the other of the shell parts (7).

6. The ballast for underwater diving belt, according to claim 5, wherein the free edges (641, 651) of one of the shell parts (6) comprise an outer cavity (642, 652) and wherein the free edges (741, 751) of the other of the shell parts (7) comprise a complementary inner cavity (742, 752).

7. An underwater diving belt, comprising a belt strip (2) on which ballasts (3) according to claim 1 are added-on.

8. A method for producing a ballast (3) according to claim 1, comprising:

a step of providing the metal core (4) and the shell part(s) (6, 7), and a step of fastening the shell part(s) (6, 7) with the metal core (4) and/or one with the other, for the holding thereof around said metal core (4).

9. The method for producing a ballast, according to claim 8, wherein the step of providing the shell part(s) (6, 7) comprises an operation of producing said shell part(s) (6, 7) by injection moulding.

10. The ballast for underwater diving belt, according to claim 1, wherein the fastening means (8) are selected from among at least one of the following fastening means:

means for gluing the shell part(s) (6, 7) with the metal core (4) and/or one with the other, means for interlocking the shell part(s) (6, 7) with the metal core (4) and/or one with the other, means for thermowelding shell parts (6, 7) together.

11. The ballast for underwater diving belt, according to claim 1, wherein the coating (5) comprises, facing each front face (411, 412) of the central core (4), a main wall (63, 73) comprising a central portion (635, 735) arranged between two side portions (636, 736), separated by two openings (632, 732), wherein, at the level of one of the main walls (63), the central portion (635) is removed with respect to the side portions (636), and wherein, at the level of the other of the main walls (73), the side portions (736) are removed with respect to the central portion (735).

* * * * *